United States Patent [19]

Oosaki

[11] 4,366,736

[45] Jan. 4, 1983

[54] APPARATUS FOR FINISHING SLIDE FASTENER STRINGERS

[75] Inventor: Tatsuo Oosaki, Uozu, Japan

[73] Assignee: Yoshida Kogyo K.K., Japan

[21] Appl. No.: 156,421

[22] Filed: Jun. 4, 1980

[30] Foreign Application Priority Data

Jun. 22, 1979 [JP] Japan ..... 54-79473
Jun. 22, 1979 [JP] Japan ..... 54-79474

[51] Int. Cl.[3] ..... B26D 7/18

[52] U.S. Cl. ..... 83/101; 83/168; 83/921

[58] Field of Search ..... 29/408, 766, 770; 83/101, 168, 921, 27; 15/21 D

[56] References Cited

U.S. PATENT DOCUMENTS 1,778,053 10/1930 White ..... 83/168
1,943,422 1/1934 Card ..... 15/21 D
2,632,939 3/1953 Evans et al. ..... 83/101
2,752,997 7/1956 Soave ..... 83/921
3,599,266 8/1971 Perrella ..... 15/21 D

FOREIGN PATENT DOCUMENTS 44-11293 5/1969 Japan ..... 83/921

*Primary Examiner*—Stephen G. Kunin
*Assistant Examiner*—K. Bradford Adolphson
*Attorney, Agent, or Firm*—Robert E. Burns; Emmanuel J. Lobato; Bruce L. Adams

[57] ABSTRACT

A chain of interdigitating coupling elements on a pair of slide fastener stringer tapes is gapped and severed into a short length of chain with coupling element residuals or debris left on the tapes at the gapped chain portion. The chain is then manually fed between and into engagement with a pair of vertically aligned circular brushes driven for continuous rotation to scrape the coupling element residuals off the tapes. A pair of guide troughs guide the chain into alignment with the brushes, each guide trough having a pair of converging sidewalls confining one of the brushes solely to frictional engagement with the chain.

3 Claims, 9 Drawing Figures

APPARATUS FOR FINISHING SLIDE FASTENER STRINGERS

BACKGROUND OF THE INVENTION

1. Field of the Invention

The present invention relates to an apparatus for finishing slide fastener stringers by gapping a chain of coupling elements, severing stringer tapes across the gapped chain portion, and removing coupling element residuals or debris from the tapes at the gapped chain portion.

2. Prior Art

A known apparatus disclosed in Japanese Patent Publication No. 44-11293 to KOBAYASHI, published May 24, 1969, automatically gaps a continuous chain of coupling elements at regular intervals as the chain is intermittently fed in the longitudinal direction. The prior apparatus includes leaf springs projecting upwardly and downwardly into the path of movement of the chain for scraping off coupling element debris left on the tapes at gapped portions in the chain. The apparatus however is disadvantageous in that it is not designed to work on separate stringers of individual slide fastener lengths already attached to garment fabrics and manually fed during the scraping operation, and the leaf springs are liable to damage the tapes during the scraping.

SUMMARY OF THE INVENTION

A pair of vertically aligned circular brushes are drivable for continuous rotation to frictionally engage a chain of coupling elements therebetween which is mounted on a pair of slide fastener stringer tapes longitudinally fed from cutter means for gapping the chain and severing the stringer tapes across the gapped portion in the chain. The circular brushes comprise brush wires of synthetic resin extending radially outwardly for scraping off coupling element residuals or debris from the stringer tapes at the gapped portion. The chain is guided into alignment with the circular brushes by a pair of guide troughs with a chain passageway therebetween, each of the guide troughs having a pair of converging sidewalls that confine the brush wires solely into contact with the chain.

It is an object of the present invention to provide an apparatus for finishing slide fastener stringers, which can reliably remove coupling element residuals or debris left on stringer tapes at gaps or spaces in the chain.

Another object of the present invention is to provide brush means for removing coupling element residuals without damaging stringer tapes on which the coupling element residuals are left.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
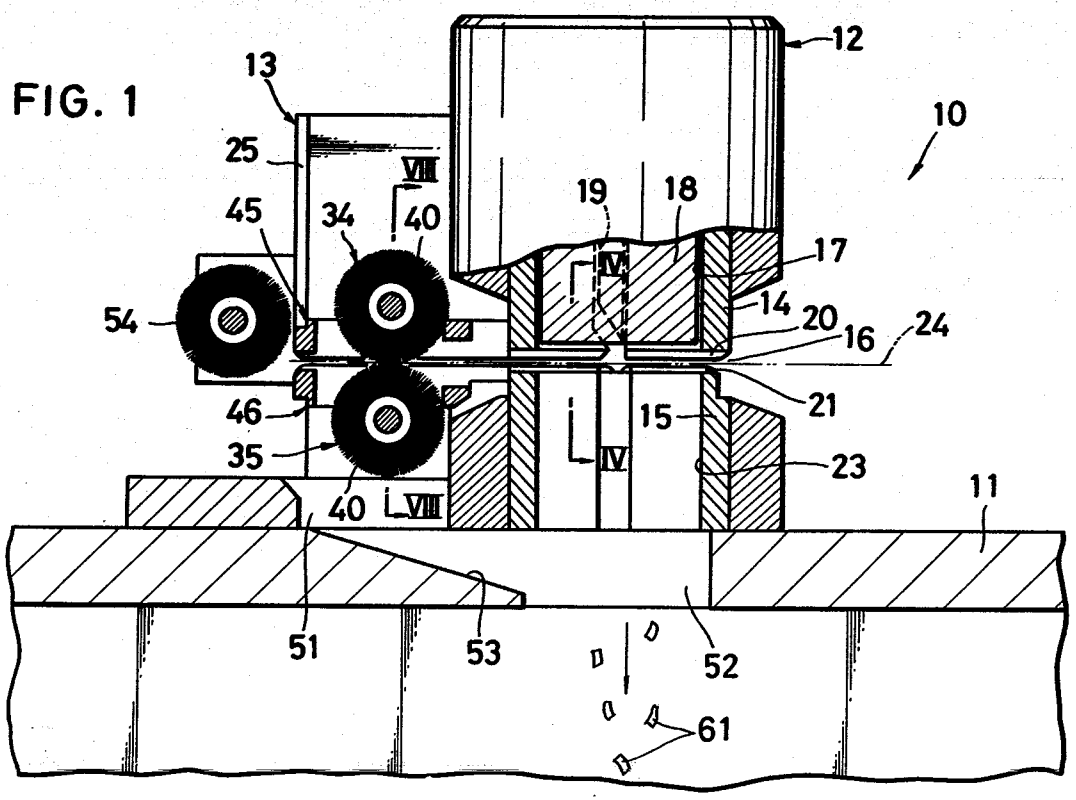
FIG. 1 is a vertical cross-sectional view of an apparatus according to the present invention.

As shown in FIG. 1, an apparatus 10 according to the present invention comprises a table 11, a cutter 12 mounted on the table 11, and a scraper 13 mounted on the table 11 adjacent to the cutter 12.

Figure 3:
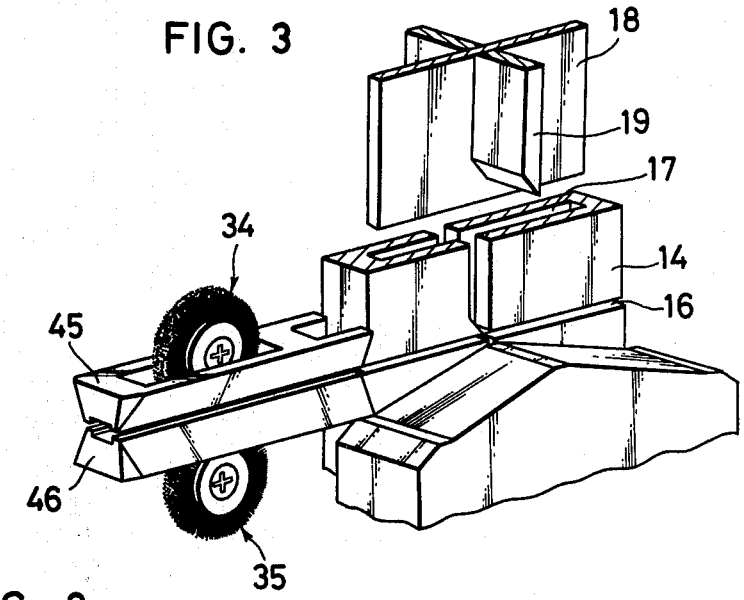
FIG. 3 is a perspective view, partly broken away, of a central portion of the apparatus.

The cutter 12 includes a punch holder 14 and a die 15 with a horizontal clearance 16 therebetween. The punch holder 14 has a vertical guide slot 17 which receives an elongate punch 18 reciprocably movable upwardly and downwardly by a suitable drive means (not shown). As best illustrated in FIG. 3, a cutter blade 19 is attached to the punch 18 in crisscross relation thereto. The punch holder 14 and the die 15 include chain guides 20,21 (FIG. 1), respectively, which jointly define an elongate chain passage 22 (FIG. 4) along the horizontal clearance 16 between the punch holder 14 and the die 15. The die 15 has a vertical slot 23 aligned with the slot 17 in the punch holder 14 so as to be receptive of the punch 18 being lowered across the chain passage 22. A slide fastener chain 24 is longitudinally advanced by hand through the chain passage 22 in vertical alignment with the punch 18.

Figure 2:
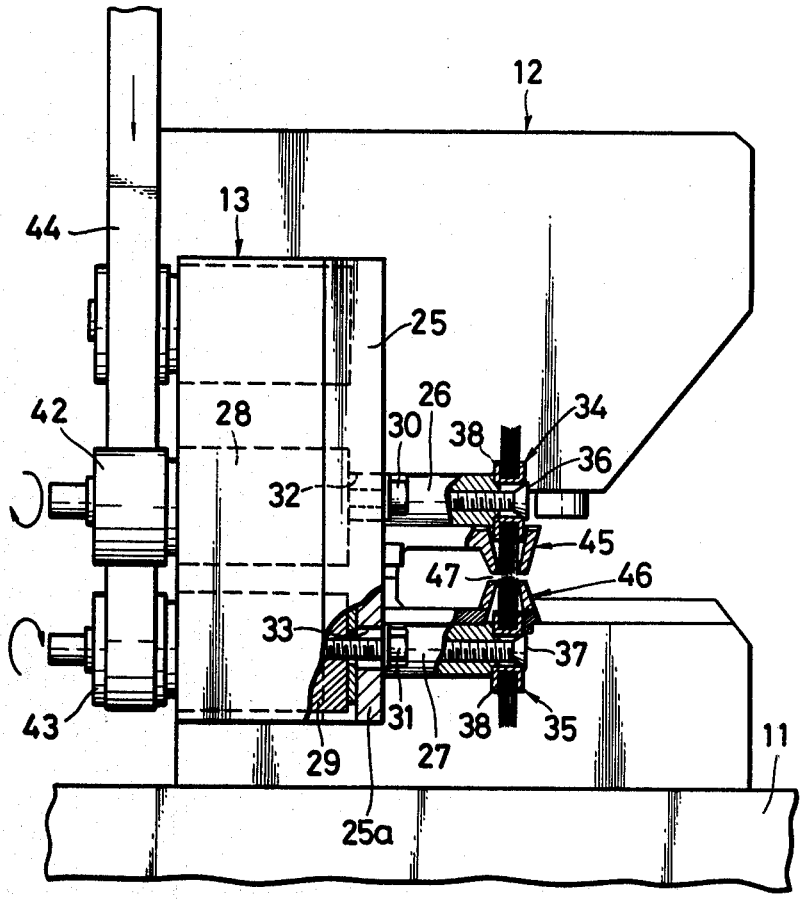
FIG. 2 is a vertical cross-sectional view of the apparatus shown in FIG. 1.

The scraper 13 comprises a support frame 25 mounted on the table 11 adjacent to the cutter 12 and supporting a pair of horizontal shafts 26,27 (FIG. 2) rotatably journalled in a pair of bearings 28,29, respectively, mounted in the support frame 25 in vertically spaced relation. The bearings 28,29 are adjustably secured to the support frame 25 by a pair of horizontal machine screws 30,31, respectively, extending through respective vertical slots 32,33 in a frame wall **25*a* threadedly into the bearings 28,29, respectively. Thus, the bearings 28,29 are positionally adjustable in a vertical sense by loosening the machine screws 30,31**.

Figure 8:
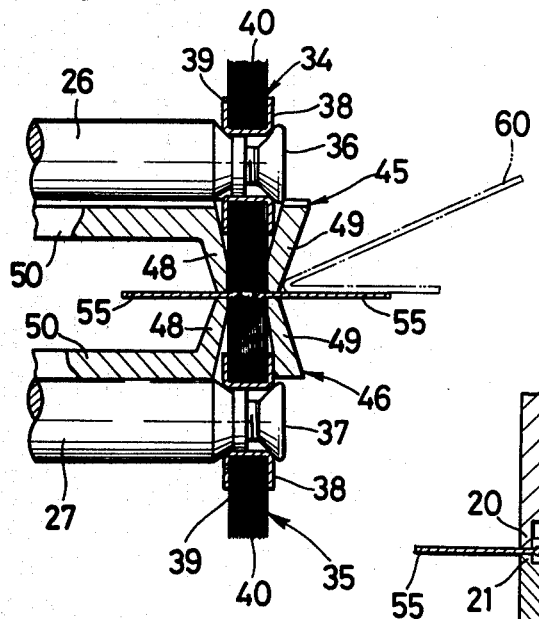
FIG. 8 is a cross-sectional view taken along line VIII—VIII of FIG. 1.

As best shown in FIG. 8, a pair of upper and lower vertically aligned circular brushes 34,35 are fixed to ends of the shafts 26,27, respectively, by a pair of machine screws 36,37 threaded into the shafts 26,27, respectively. Each of the brushes 34,35 comprises an annular collar 38 retained by the screw head against one of the shafts 26,27 and having an annular groove 39 opening radially outwardly, and a multiplicity of brush wires 40 of synthetic resin fastened circumferentially in the annular groove 39 and extending radially therefrom.

A pair of pulleys 42,43 (FIG. 2) are attached coaxially to the shafts 26,27, respectively, remotely from the brushes 34,35. An endless belt 44 extends around the pulleys 42,43 such that the pulleys 42,43 are drivable by the belt 44 to rotate in opposite directions.

An illustrated in FIGS. 3 and 8, a pair of upper and lower trough-shaped guide members 45,46 receive and guide the brushes 34,35, respectively, and are each supported by a support arm 50 extending horizontally from the frame 25, there being a horizontal clearance or passageway 47 (FIG. 2) between the guide members 45,46. Each of the guide members 45,46 comprises a pair of spaced sidewalls 48,49 converging toward the passageway 47. Each of the brushes 34,35 is disposed in part between the spaced sidewalls 48,49. The brushes 34,35 are confined by and between the sidewalls 48,49 of the guide members 45,46, respectively, to exact vertical alignment with each other in and along the passageway 47.

In FIG. 1, the support frame 25 has a discharge opening 51 just below the brush 35. The discharge opening 51 communicates with another discharge opening 52 in the table 11 that is disposed beneath and communicates with the vertical slot 23. A chute 53 extends between the discharge openings 51,52.

Another circular brush 54 which is of substantially the same structure as the brushes 34,35 is freely rotatably supported on the support frame 25 adjacent to the brushes 34,35.

A pair of continuous slide fastener stringer tapes 55,55 to be processed by the apparatus 10 (FIG. 7) support interdigitating coupling elements 56 of metal or synthetic resin clamped on confronting beaded edges 57,57 (FIG. 5) of the stringer tapes 55,55, respectively, the interdigitating coupling elements 56 constituting the slide fastener chain 24. Each coupling element 56 comprises a coupling head **56*a* and a pair of legs 56*b* clinched around the beaded edge 57, the legs 56*b* having opposite teeth 56*c* that bite the beaded edge 57 for secure attachment of the coupling element 56 to the stringer tape 55**.

Figure 4:
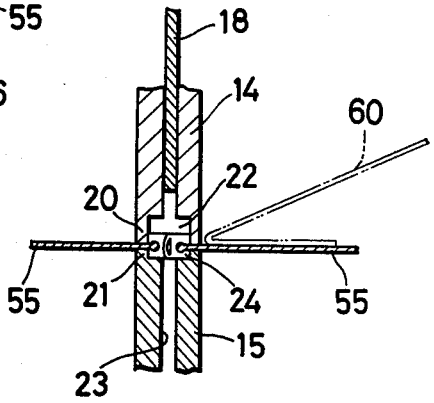
FIG. 4 is a cross-sectional view taken along line IV—IV of FIG. 1.
Figure 7:
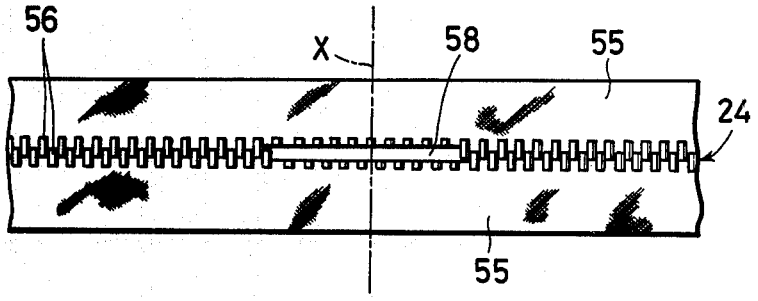
FIG. 7 is a plan view of a pair of stringer tapes with a gapped chain of coupling elements.
Figure 5:
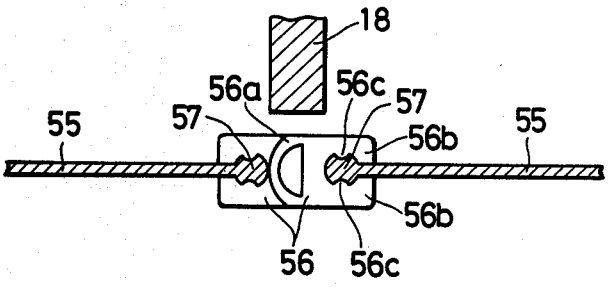
FIGS. 5 and 6 are enlarged cross-sectional views of a chain of coupling elements before and after it is gapped, respectively.
Figure 6:
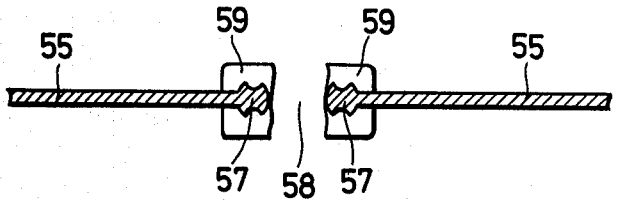

In operation, the stringer tapes 55,55 with the chain 24 are fed longitudinally into the clearance 16 between the punch holder 14 and the die 15 in a leftward direction as shown in FIG. 1, with the chain 24 being guided by the chain guides 20,21 into vertical alignment with the punch 18, as illustrated in FIG. 4. At this time, any garment fabric 60 that may be sewn to one of the stringer tapes 55 is put aside away from the punch holder 14 so as not to interfere with subsequent operation. The longitudinal feeding of the stringer tapes 55,55 is stopped when the cutter blade 19 finds therebelow a portion of the tapes 55,55 where they are to be cut off. Then, the punch 18 is lowered to cut away the coupling heads **56*a* of coupling elements 56 located therebelow to provide a longitudinal gap or space 58 in the chain 24 as shown in FIGS. 5–7. Coupling element pieces 61 thus severed fall through the slot 23 in the die 15 so as to be discharged out through the discharge opening 52. At the same time, the cutter blade 19 severs the stringer tapes 55,55 transversely across the gap 58 along the line X of FIG. 7. After the gapping, coupling element residuals or debris 59 that is constituted by the legs 56*b* remains attached to the beaded edges 57,57 of the stringer tapes 55,55**.

Figure 9:
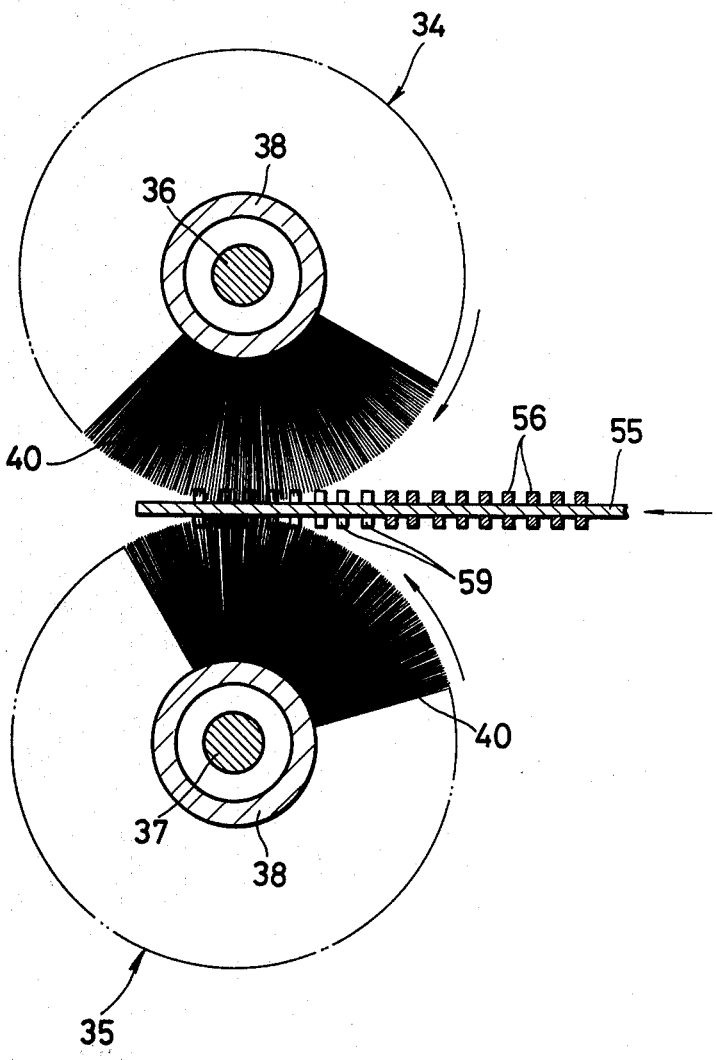
FIG. 9 is an enlarged cross-sectional view of brush means for scraping off coupling element residuals.

A severed length of the stringer tapes 55,55 is then manually advanced into the passageway 47 between the upper and lower guide members 45,46. The brushes 34,35 as they rotate start to frictionally engage the coupling elements 56, which however remains securely anchored on the tapes 55,55 due to clamping engagement with the beaded edges 57,57. As the tapes 55,55 continue to move forwardly, the coupling element residuals 59 are brought into contact with the brushes 34,35 being revolved, whereupon the residuals 59 are scraped off the tapes 55,55 since they now merely adhere to the beaded edges 57,57 (FIGS. 8 and 9). The brushes 34,35 are guided by the guide members 45,46 so as not to damage the stringer tapes 55,55 while the brushes 34,35 are rubbing the chain 24 and scraping off the residuals 59. The scraped residuals 59 that may have flown away beyond the guide members 45,46 are prevented by the brush 54 from being scattered around. For this purpose, the brush 54 may be replaced with a piece of cloth hanging adjacent to the guide members 45,46.

Severed coupling element residuals 59 scraped off by the brushes 34,35 fall through the discharge opening 51, down the chute 53, and are discharged out through the discharge opening 52.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An apparatus for finishing slide fastener stringers, comprising:

(a) cutter means for gapping a chain of interdigitating coupling elements on a pair of stringer tapes fed along a longitudinal path and for severing the stringer tapes across the gapped portion in the chain substantially at the same time the chain of coupling elements is gapped;

(b) brush means located downstream of said cutter means along said longitudinal path and comprising a pair of circular brushes disposed one on each side of said longitudinal path for rubbing on their peripheries the chain at opposite sides thereof, respectively, said brush means being continuously rotatable for frictionally engaging the chain to scrape off coupling element residuals at the gapped portion from the stringer tapes; and (c) guide means for guiding said pair of slide fastener stringers from said cutter means through said brush means, said guide means defining therein an elongate passage extending along said longitudinal path between said cutter and brush means for guiding the chain into alignment with said cutter and brush means as the chain is fed along said longitudinal path, said guide means including respective pairs of sidewalls disposed on opposite sides of each of said brushes and converging toward said longitudinal path for constraining the brushes to a width generally equal to a width of said chain of interdigitating coupling elements guided by said guide means between said brushes.

2. An apparatus according to claim 1, each of said brushes comprising a driven collar and a multiplicity of brush wires of synthetic resin fastened circumferentially to said collar and extending radially therefrom.

3. An apparatus according to claim 1, including means for adjusting the distance between said pair of circular brushes.

* * * * *